US008800509B2

(12) United States Patent
Uenoyama et al.

(10) Patent No.: US 8,800,509 B2
(45) Date of Patent: Aug. 12, 2014

(54) SCAVENGING PASSAGE STRUCTURE FOR TWO-STROKE ENGINE

(75) Inventors: Kazuyuki Uenoyama, Tokyo (JP); Takahiro Kimura, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/581,896

(22) PCT Filed: Mar. 23, 2011

(86) PCT No.: PCT/JP2011/056870

§ 371 (c)(1),
(2), (4) Date: Aug. 30, 2012

(87) PCT Pub. No.: WO2011/135948

PCT Pub. Date: Nov. 3, 2011

(65) Prior Publication Data

US 2012/0325191 A1 Dec. 27, 2012

(30) Foreign Application Priority Data

Apr. 27, 2010 (JP) ..... 2010-102148

(51) Int. Cl.
*F02B 25/00* (2006.01)
*F02B 33/12* (2006.01)
*F02B 33/00* (2006.01)

(52) U.S. Cl.
USPC ..... 123/73 PP; 123/74 B; 123/65 VB; 123/65 B

(58) Field of Classification Search
USPC ..... 123/73 PP, 74 B, 65 VB, 65 P
See application file for complete search history.

(56) References Cited

U.S. PATENT DOCUMENTS 4,294,201 A 10/1981 Swartz
4,445,468 A * 5/1984 Onishi et al. ..... 123/73 C (Continued)

FOREIGN PATENT DOCUMENTS

CN 85203399 7/1986
CN 2245670 1/1997

(Continued)

OTHER PUBLICATIONS

International Preliminary Report on Patentability and Written Opinion of the International Searching Authority issued Dec. 10, 2012 in corresponding International Application No. PCT/JP2011/056870 (with English translation).

(Continued)

*Primary Examiner* — Lindsay Low
*Assistant Examiner* — Charles Brauch
(74) *Attorney, Agent, or Firm* — Wenderoth, Lind & Ponack, L.L.P.

(57) ABSTRACT

A scavenging passage structure for a two-stroke engine, having a scavenging passage communicating a scavenging port provided in a cylinder with a crank chamber formed inside a crankcase, the scavenging passage being formed to extend through respective fastening surfaces of the cylinder and the crankcase. The scavenging passage includes a cover member attached inside the crankcase to be in contact with an inner wall surface of the crankcase, and a groove formed in at least one of the inner wall surface of the crankcase contacting the cover member, and the cover member contacting the inner wall surface of the crankcase, the groove forming part of the scavenging passage connecting to the crank chamber and to an upper face of the crankcase.

9 Claims, 6 Drawing Sheets

(56) References Cited

U.S. PATENT DOCUMENTS

| | | | | |
|---|---|---|---|---|
| 5,345,897 | A | 9/1994 | Linder et al. | |
| 5,524,578 | A * | 6/1996 | Craft et al. | 123/65 P |
| 5,671,703 | A * | 9/1997 | Otome et al. | 123/65 P |
| 5,947,066 | A * | 9/1999 | Ishikawa | 123/65 P |
| 5,992,358 | A * | 11/1999 | Otome | 123/65 P |
| 2007/0119404 | A1 | 5/2007 | Yuasa et al. | |
| 2007/0119405 | A1* | 5/2007 | Mizuno et al. | 123/196 R |
| 2011/0162630 | A1* | 7/2011 | Takayanagi | 123/73 V |

FOREIGN PATENT DOCUMENTS

| | | | |
|---|---|---|---|
| CN | 2660142 | | 12/2004 |
| CN | 2893178 | | 4/2007 |
| CN | 100507228 | | 7/2009 |
| CN | 101649771 | A | 2/2010 |
| EP | 2 055 409 | A1 | 5/2009 |
| JP | 2002-332846 | | 11/2002 |
| JP | 2007-146770 | | 6/2007 |
| JP | 2007-285219 | | 11/2007 |
| JP | 4031602 | | 1/2008 |
| TW | 235193 | | 7/2005 |
| TW | 286289 | | 1/2006 |
| TW | 255884 | | 6/2006 |
| TW | 265235 | | 11/2006 |
| TW | 271471 | | 1/2007 |
| WO | 2010/035684 | A1 | 4/2010 |

OTHER PUBLICATIONS

International Search Report issued Jun. 14, 2011 in corresponding International Application No. PCT/JP2011/056870.

Notice of Allowance (and English translation thereof) issued Jul. 1, 2013 in corresponding Japanese Application No. 2012-512718.

Machine translation of JP4031602 previously cited in an IDS filed on Aug. 30, 2012.

Korean Notice of Allowance dated Dec. 11, 2013 issued in corresponding Korean Application No. 10-2012-7022735 (with English translation).

Taiwanese Notice of Allowance issued Nov. 28, 2013 in corresponding Taiwanese ApplicationNo. 100113192 (with English translation).

Taiwanese Office Action issued Aug. 16, 2013 in corresponding Taiwanese Application No. 100113192. (with English Translation).

Chinese Office Action (with English translation) issued Mar. 5, 2014 in corresponding Chinese Application No. 201180011695.8.

* cited by examiner

SCAVENGING PASSAGE STRUCTURE FOR TWO-STROKE ENGINE

TECHNICAL FIELD

The present invention relates to a scavenging passage structure for a two-stroke engine having a scavenging passage communicating a scavenging port provided in a cylinder with a crank chamber inside a crankcase, the scavenging passage extending through respective fastening surfaces of the cylinder and the crankcase.

BACKGROUND ART

In two-stroke engines, scavenging passages that open to the crank chamber formed inside the crankcase extend as smoothly curved passages inside the crankcase to the fastening surfaces of the crankcase and the cylinder, through the scavenging passages, and connect to scavenging ports provided in the cylinder.

FIG. 8 is an exploded perspective view of a crankcase and a cylinder of a conventional two-stroke engine. FIG. 9 is a cross section along F-F of FIG. 8, which is a cross-sectional view of the crankcase of the conventional two-stroke engine as viewed from a direction orthogonal to the crankshaft axis. FIG. 10 is a diagram as viewed in the direction of arrows G-G in FIG. 9, which is a top view of the crankcase. FIG. 11 is a cross section as viewed in the direction of arrows H-H in FIG. 10.

In FIG. 8 to FIG. 11, reference numeral 101 denotes a cylinder; a combustion chamber is formed inside the cylinder 101. There are provided a piston 130 moving up and down inside the cylinder 101, and a crankshaft 108 for converting the up and down movement of the piston 130 into rotational force.

Reference numeral 102 denotes the crankcase, inside which a crank chamber 106 is formed. Reference numeral 140 denotes two scavenging ports provided in side portions of the cylinder 101 to face opposite each other, FIG. 8 showing only one of these. The scavenging ports 140 are each communicated with the crank chamber 106 via scavenging passages 104*b* inside the cylinder 101, scavenging passages 104*a* formed in a curved shape in both side walls of the crankcase 102, and a pair of scavenging passage inlets 104*c*.

Reference numeral 118 denotes air passages for supplying leading air, connected midway of the scavenging passages 104*b* so that leading air from an air cleaner is supplied to the scavenging ports 140 through the air passages 118 and scavenging passages 104*b*.

Reference numeral 132 denotes an insulator for thermally insulating the intake system from the engine body, the insulator 132 being fastened to a side face of the cylinder 2 with bolts. An upper passage 132*a* inside the insulator 132 forms an air passage for supplying leading air. This air passage is connected midway of the scavenging passages 104*b*, so that leading air is supplied to the scavenging ports 140 via the air passages 118 and scavenging passages 104*b*. A lower passage 132*b* inside the insulator 132 forms an air/fuel mixture passage for supplying an air/fuel mixture into the crank chamber 106. This air/fuel mixture passage communicates with inside of the cylinder 101 via an intake port 142.

In FIG. 8, the crankcase 102 is made up of a front crankcase 102*a* and a rear crankcase 102*b* that are front and back parts divided at a front and back split surface 125 orthogonal to the crankshaft axis 180. After the crankshaft 108 and others have been assembled inside, the front crankcase 102*a* and rear crankcase 102*b* are fastened together and united, with a plurality of bolts using bolt holes 126.

Reference numeral 103 denotes a flat and smooth cylinder mounting surface formed at the top of the crankcase 102. The cylinder 101 is fastened with a plurality of bolts 114, with its lower face 103' making contact with this cylinder mounting surface 103.

The scavenging passages 104*a* and the scavenging passage inlets 104*c* are each formed inside the front crankcase 102*a* and rear crankcase 102*b* symmetrically about the front and back split surface 125. The upper ends of the scavenging passages 104*a* are open in the cylinder mounting surface 103.

Reference numeral 110 denotes guide members, inserted from the openings in the cylinder mounting surface 103, their upper faces forming part of the cylinder mounting surface 103. The guide members 110 are formed with passage surfaces that smoothly connect to the scavenging passages 104*a*. The guide members 110 are provided with protrusions, for example, in their upper faces and sides, while grooves are cut in the crankcase 102, so that the guide members are fastened to the crankcase 102 with these protrusions fitted in the grooves.

In the two-stroke engine equipped with the scavenging passage structure configured as shown in FIG. 8 to FIG. 11, the air/fuel mixture from the crank chamber 106 formed inside the crankcase 102 is introduced into the scavenging passages 104*a* partly formed by the guide members 110 having passage surfaces formed as smooth curved surfaces, via the scavenging passage inlets 104*c*, and flows through the scavenging passages 104*a* formed as smoothly curved passages, and through the scavenging passage 104*b* formed in the cylinder, to be supplied to the scavenging ports 140. The air/fuel mixture is thus supplied as a smooth and powerful flow into the scavenging ports 140 without any flow loss such as a flow rate reduction, as the mixture flows through the scavenging passages 104*a* formed as smoothly curved passages without turns at right angles or the like.

The conventional scavenging passage structure for a two-stroke engine using the guide members described using FIG. 8 to FIG. 11 is disclosed in Patent Document 1.

CITATION LIST

Patent Literature

Patent Document 1: Japanese Patent No. 4031602

SUMMARY OF THE INVENTION

Technical Problem

However, with the conventional scavenging passage structure for a two-stroke engine using the guide members 110 disclosed in Patent Document 1 and described using FIG. 8 to FIG. 11, to produce the front crankcase 102*a* and rear crankcase 102*b* by die casting, slide cores for forming the scavenging passages are necessary. In this case, the die casting is performed, with a slide core that can slide in a direction toward the cylinder mounting surface 103 being inserted into a portion that will form the scavenging passage 104*a*, after which the slide core is slid in the direction toward the cylinder mounting surface 103 and extracted to allow ejection of the casting. The guide members 110 are inserted into and secured in the portions where the slide cores existed, to form the scavenging passages 104*a*. Namely, the cost of the entire die set is high because of the presence of the slide cores.

Also, the use of the slide cores increases the number of steps for forming the scavenging passages for the two-stroke engine, causing the problem of increased cost required for the formation of the scavenging passages.

Accordingly, in view of such a problem encountered by the conventional technique, an object of the present invention is to provide a scavenging passage structure for a two-stroke engine, with which scavenging passages communicating scavenging ports provided in the cylinder with the crank chamber inside the crankcase can be formed without using slide cores, so that the production cost arising from the use of slide cores is cut down.

Solution to Problem

To solve the problem mentioned above, the present invention provides a scavenging passage structure for a two-stroke engine, having a scavenging passage communicating a scavenging port provided in a cylinder with a crank chamber formed inside a crankcase, the scavenging passage being formed to extend through respective fastening surfaces of the cylinder and the crankcase, characterized in that the scavenging passage structure further has a cover member attached inside the crankcase to be in contact with an inner wall surface of the crankcase, and a groove formed in a contact surface between the inner wall surface of the crankcase and the cover member, and forming part of the scavenging passage connecting to the crank chamber and to an upper face of the crankcase.

Thereby, even though the crankcase is produced by die casting, there is no need to use slide cores, which are slid toward the cylinder mounting surface to allow extraction of the casting. As there is no need to use slide cores, the production cost for slide cores is made unnecessary. Accordingly, the production cost required for configuring the scavenging passages for a two-stroke engine can be reduced.

The groove may be recessed in the inner wall surface of the crankcase and the cover member may be attached in contact with the inner wall surface of the crankcase so as to close an open part of the groove.

This way, as grooves need not be provided in the cover member, a general-purpose component can be used as the cover member. This allows inexpensive replacement of cover members when failure occurs.

The groove may be recessed in the cover member, and the cover member may be attached in contact with the inner wall surface of the crankcase so as to close an open part of the groove.

Thereby, the production cost can be reduced as the slide cores are made unnecessary, and also, the die design used for producing the crankcase can be made simpler, as no grooves are formed in the crankcase.

The groove may be recessed both in the inner wall surface of the crankcase and in the cover member, and the cover member may be attached in contact with the inner wall surface of the crankcase so that respective open parts of the grooves provided in the inner wall surface of the crankcase and in the cover member face opposite each other.

Thereby, the production cost can be reduced as the slide cores are made unnecessary, and also, the cover member can be positioned to the crankcase more easily since the mounting position of the cover member to the crankcase is determined by the positions of the grooves each provided in the crankcase and the cover member.

The cover member may be attached to the inner wall surface at a mounting position determined by being fitted in between opposite inner wall surfaces of the crankcase.

This allows simple and reliable positioning between the cover member and the crankcase, ensuring correct formation of the scavenging passage.

The present invention can provide a scavenging passage structure for a two-stroke engine, which allows formation of scavenging passages communicating the scavenging ports in the cylinder with the crank chamber inside the crankcase without using slide cores, whereby the production cost incurred by the use of slide cores can be cut down.

DETAILED DESCRIPTION OF THE INVENTION

Preferred embodiments of the present invention will be hereinafter illustratively described in detail with reference to the drawings. It should be understood that the sizes, materials, and shapes of the constituent elements described in the embodiments, and their positions relative to each other, are given for illustrative purposes only and not meant to limit the scope of this invention, unless specifically stated otherwise.

(Embodiment 1)

Figure 1:
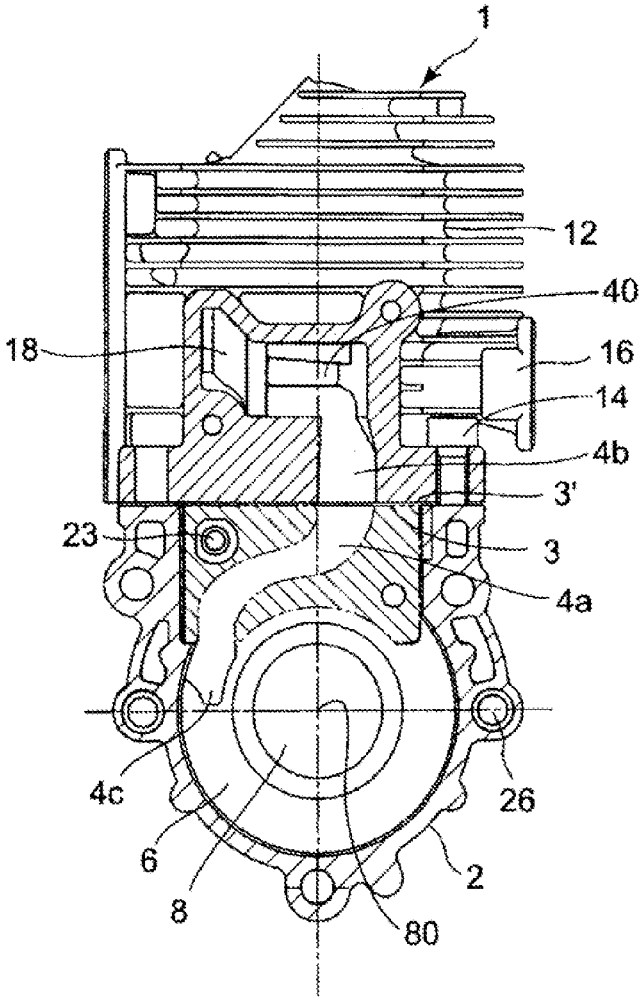
FIG. 1 is a structural view illustrating a scavenging passage structure for a two-stroke engine according to Embodiment 1 as viewed from a direction orthogonal to the crankshaft axis.
Figure 2:
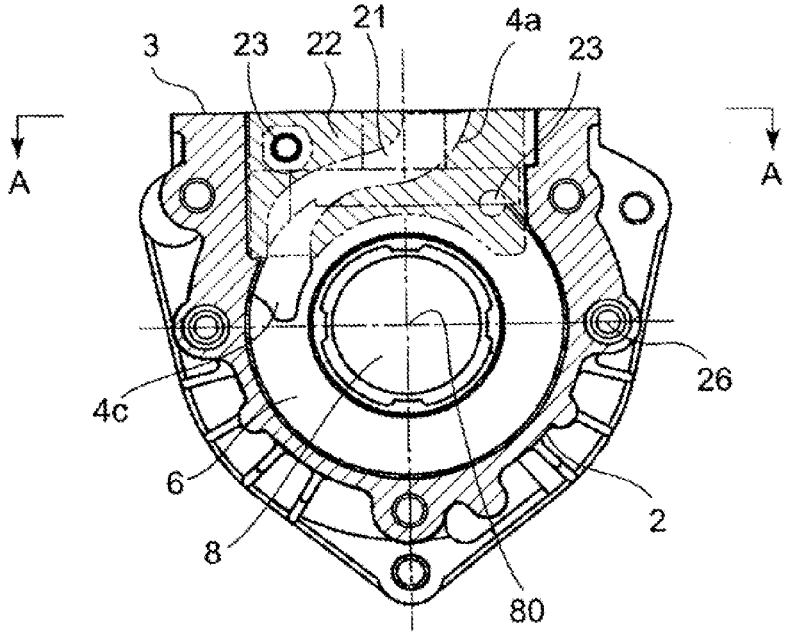
FIG. 2 is a cross-sectional view of a crankcase in which the scavenging passage structure for a two-stroke engine according to Embodiment 1 is formed, as viewed from a direction orthogonal to the crankshaft axis.
Figure 3:
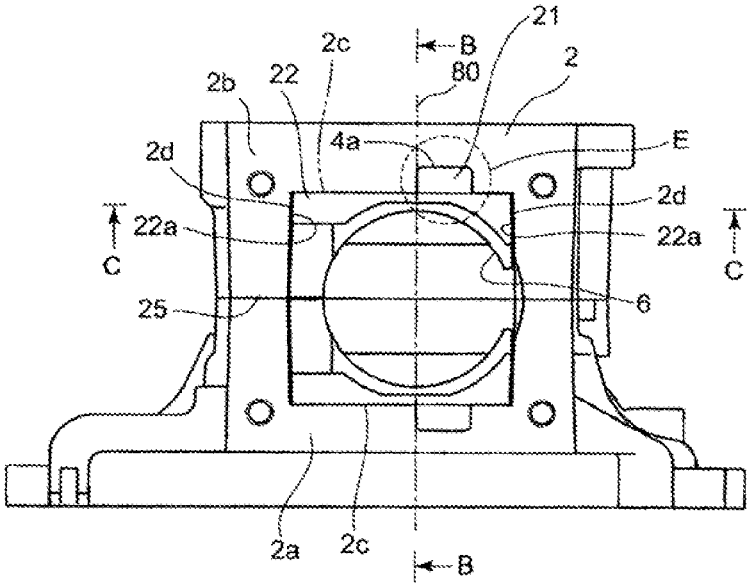
FIG. 3 is a diagram as viewed in the direction of arrows A-A in FIG. 2.
Figure 4:
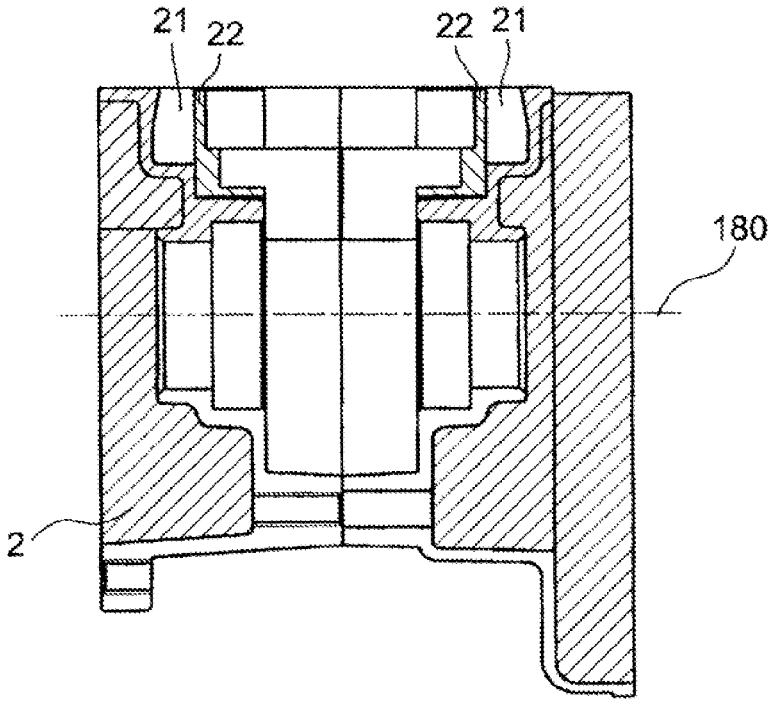
FIG. 4 is a cross section as viewed in the direction of arrows B-B in FIG. 3.

FIG. 1 is a cross-sectional view of a crankcase and a cylinder of a two-stroke engine according to Embodiment 1 of the present invention as viewed from a direction orthogonal to the crankshaft axis. FIG. 2 is a cross-sectional view of the crankcase in which a scavenging passage structure for a two-stroke engine according to Embodiment 1 of the present invention is formed, as viewed from a direction orthogonal to the crankshaft axis corresponding to a cross section along C-C of FIG. 3. FIG. 3 is a diagram as viewed in the direction of arrows A-A in FIG. 2, and FIG. 4 is a diagram as viewed in the direction of arrows B-B in FIG. 3.

Figure 5:
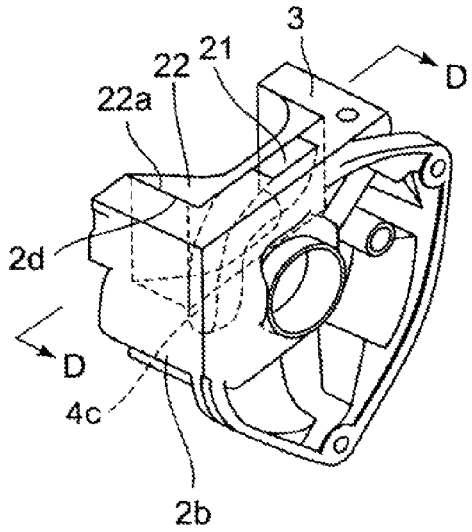
FIG. 5 is a perspective view of a rear crankcase 2*b;*

The crankcase 2 is made up of a front crankcase 2*a* (a front crankcase portion) and a rear crankcase 2*b* (a rear crankcase portion) that are front and back parts divided at a front and back split surface 25 orthogonal to the crankshaft axis 80. After the crankshaft 8 and others have been assembled inside, the front crankcase 2*a* and rear crankcase 2*b* are fastened together and united with a plurality of bolts 26. FIG. 5 is a perspective view of the rear crankcase 2*b*; FIG. 3 is a cross section along D-D of FIG. 5.

In FIG. 1 to FIG. 5, reference numeral 1 denotes the engine, which is configured as described below. Reference numeral 12 denotes a cylinder, which is fastened to the crankcase 2 with a plurality of bolts 14 via a gasket, at their respective fastening surfaces, i.e., a cylinder mounting surface 3 that is the upper face of the crankcase 2 and the lower face 3' of the cylinder. Reference numeral 16 denotes an exhaust port opened in a side portion of the cylinder 12 and connected to an exhaust passage.

Reference numeral 40 denotes two scavenging ports provided in side portions of the cylinder 12 to face opposite each other, FIG. 1 showing only one of these. Scavenging passages 4*b* formed inside the cylinder 12 are connected to the scavenging ports 40. Reference numeral 4*c* denotes a scavenging passage inlet opened into a crank chamber 6 formed inside the crankcase 2. Reference numeral 4*a* denotes a scavenging passage formed as a smoothly curved passage inside the crankcase 2. The scavenging passages 4*a* extend through the fastening surfaces 3 and 3' of the crankcase 2 and the cylinder 12 so as to connect the scavenging passages 4*b* inside the cylinder 12 and the scavenging passage inlets 4*c*. The scavenging ports 40 are thus communicated with the crank chamber 6 through the scavenging passages 4*b*, scavenging passages 4*a*, and scavenging passage inlets 4*c* configured as described above.

Reference numeral 18 denotes an air passage for supplying leading air, connected midway of the scavenging passages 4*b* so that leading air from an air cleaner (not shown) is supplied to the scavenging ports 40 through the air passage 18 and scavenging passages 4*b*.

The scavenging passages 4*a* inside the crankcase 2 are formed as described below. The crankcase 2 is provided with grooves 21 in contact surfaces with cover members 22, the grooves being recessed into the direction of the crankshaft axis 80 as shown in FIG. 3. The grooves 21 are open toward inside of the crankcase 2, the remaining parts being formed as a smoothly curved passage to form the scavenging passages 4*a*.

On the open side of the grooves 21 formed in the crankcase 2, the cover members 22 are attached in contact with inner wall surfaces 2*c* of the crankcase 2. The cover members 22 close the open side of the grooves 21, attached in contact with the inner wall surfaces of the crankcase 2, and fastened to the crankcase 2 with fastening members 23 such as bolts.

The crankcase 2 further includes two inner wall surfaces 2*d* opposite each other at both ends of the inner wall surfaces 2*c* in which the grooves 21 are provided, the cover members 22 being fitted in between the two inner wall surfaces 2*d*. As the cover members 22 are fitted in between the two opposing inner wall surfaces 2*d*, the mounting position of the cover members 22 is determined.

The open side of the grooves 21 recessed into the direction of the crankshaft axis 80 in the crankcase 2 is thus closed by the cover members 22 so that the grooves 21 and cover members 22 together form passages, these passages being the scavenging passages 4*a*.

In the two-stroke engine with the scavenging passage structure having the configuration shown in FIG. 1 to FIG. 5, the air/fuel mixture from the crank chamber 6 formed inside the crankcase 2 is introduced from the scavenging passage inlets 4*c* into the scavenging passages 4*a* that are formed to have smooth curved surfaces, flows through the scavenging passages 4*a* and 4*b*, and is supplied to the scavenging ports 40. The air/fuel mixture is thus supplied as a smooth and powerful flow into the scavenging ports 9 without any flow loss such as a flow rate reduction, as the mixture flows through the scavenging passages 4*a* formed as smoothly curved passages without turns at right angles or the like.

With Embodiment 1, the scavenging passages 4*a* inside the crankcase 2 are formed by the grooves 21 and the cover members 22, the grooves being provided in the contact surfaces 2*c* between the crankcase 2 and the cover members 22. Therefore, the rear crankcase 2*b* can be produced by die casting, using a die set designed to form a groove 21, the cover member 22 then being brought into contact with the inner wall surface 2*c* of the rear crankcase 2*b* so as to close the open side of the groove 21 from the side of the front and back split surface 25 and fastened there with the bolts 23. The front crankcase 2*a* is produced similarly with the rear crankcase 2*b*, after which the front crankcase 2*a* and the rear crankcase 2*b* are fastened together and united with the bolts 26, so that the crankcase 2 is complete.

Therefore, even though the crankcase is produced by die casting, there is no need to use slide cores, which are slid toward the cylinder mounting surface 3 on the upper face of the crankcase 2 that is the fastening surface with the cylinder 12, to allow extraction of the casting, for forming the scavenging passages 4*a*.

As there is no need to use slide cores, the production cost for slide cores is made unnecessary. Accordingly, the production cost required for configuring the scavenging passages for a two-stroke engine can be reduced.

The cover members 22 take up part of the space inside the crankcase 2. An extremely large space left inside the crankcase 2 would cause a reduction in compression ratio of the crankcase 2. The provision of the cover members 22 can prevent such reduction in the compression ratio.

(Embodiment 2)

Figure 6:
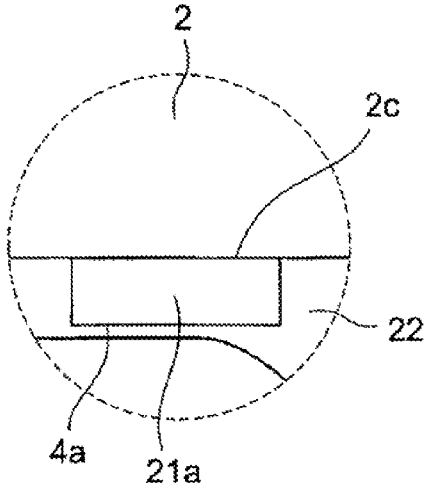
FIG. 6 is a schematic view of the vicinity of the scavenging passage according to Embodiment 2.

FIG. 6 is a top view of the vicinity of a scavenging passage provided in the crankcase according to Embodiment 2, of the part in Embodiment 2 corresponding to part E shown in FIG. 3 of Embodiment 1, shown to a larger scale. The features other than the structure of the scavenging passage 4*a* in Embodiment 2 are the same as those of Embodiment 1 described using FIG. 1 to FIG. 5.

In Embodiment 2, no grooves are formed in the crankcase 2, and instead, grooves 21*a* are formed in the contact surfaces of the cover members 22 contacting the inner wall surfaces of the crankcase so as to be recessed in the direction of the crankshaft axis 80. The grooves 21*a* are open on the side opposite the inner wall surfaces 2*c* of the crankcase 2 that is in contact with the cover members 22. The remaining parts are formed in smooth curves to form the scavenging passages 4*a*.

The cover members 22 are attached so that the open side of the grooves 21*a* thereof makes contact with the inner wall surfaces of the crankcase 2. The cover members 22 are attached in contact with the inner wall surfaces of the crankcase 2 so that the open grooves 21*a* are closed, and fastened in position with fastening members such as bolts to the inner wall surfaces 2*c* of the crankcase 2.

Thus the open side of the grooves 21*a* provided in the cover members 22 is closed by the inner wall surfaces 2*c* of the crankcase 2 so that the grooves 21*a* and the inner wall surfaces 2*c* of the crankcase 2 together form passages, these passages being the scavenging passages 4*a*.

As in Embodiment 2 described using FIG. 6, grooves 21*a* may be provided in the cover members 22 and not in the crankcase 2.

Thereby, the production cost can be reduced as the slide cores are made unnecessary, as with Embodiment 1, and also, the die design used for producing the crankcase can be made simpler.

(Embodiment 3)

Figure 7:
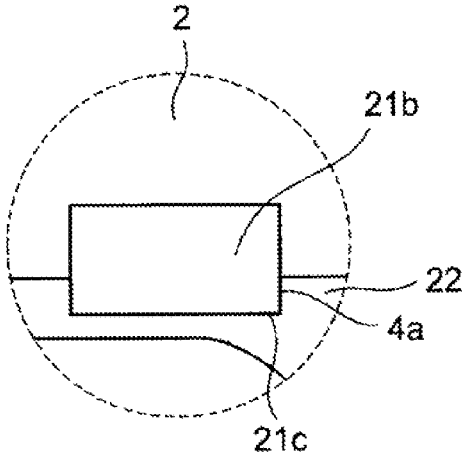
FIG. 7 is a schematic view of the vicinity of the scavenging passage according to Embodiment 3.
Figure 8:
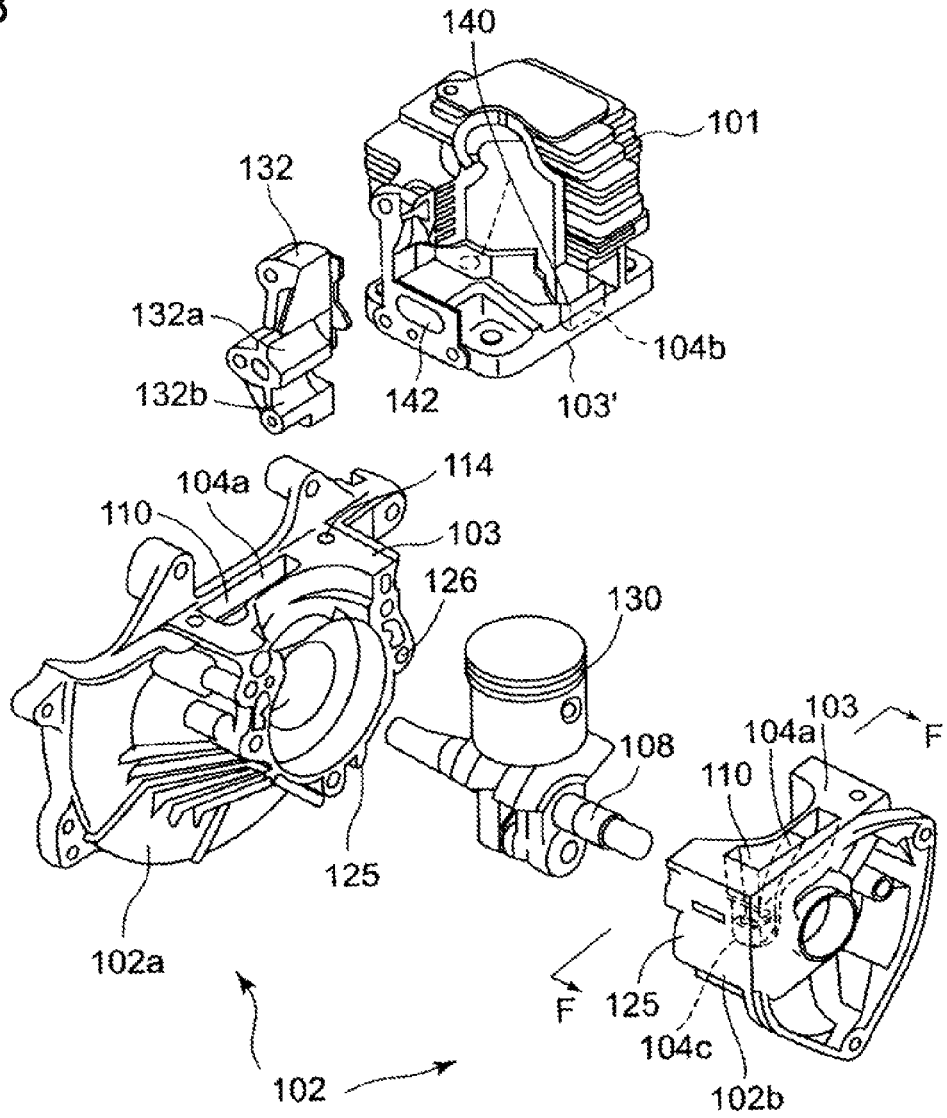
FIG. 8 is an exploded perspective view of a crankcase and a cylinder of a conventional two-stroke engine.
Figure 9:
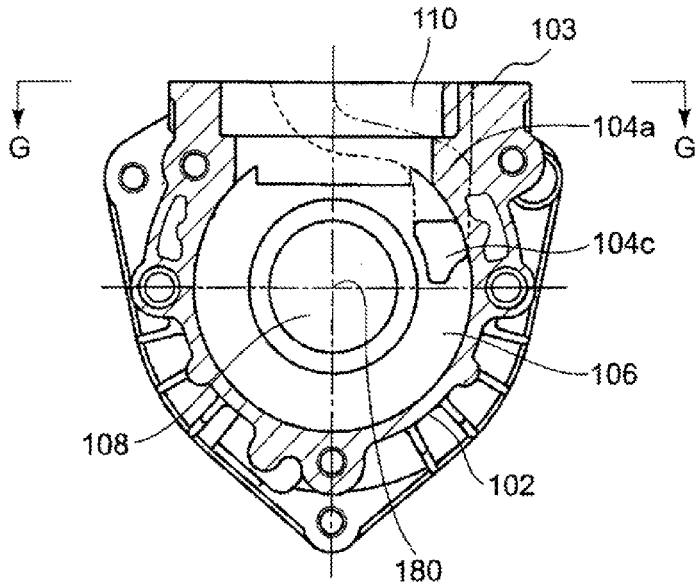
FIG. 9 is a cross-sectional view of the crankcase of the conventional two-stroke engine in which a scavenging passage structure is formed, as viewed from a direction orthogonal to the crankshaft axis.
Figure 10:
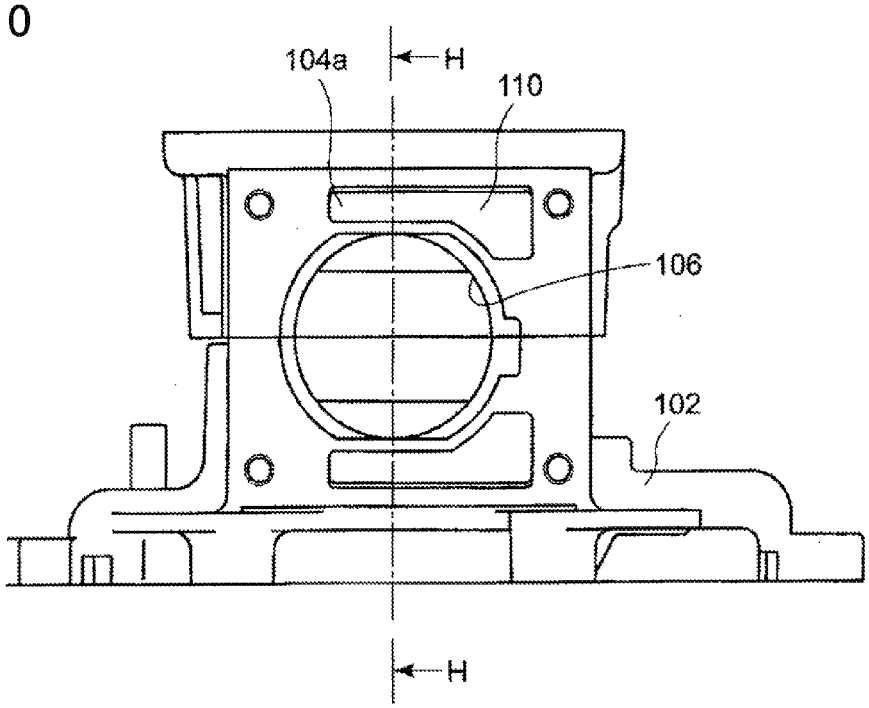
FIG. 10 is a diagram as viewed in the direction of arrows G-G in FIG. 9.
Figure 11:
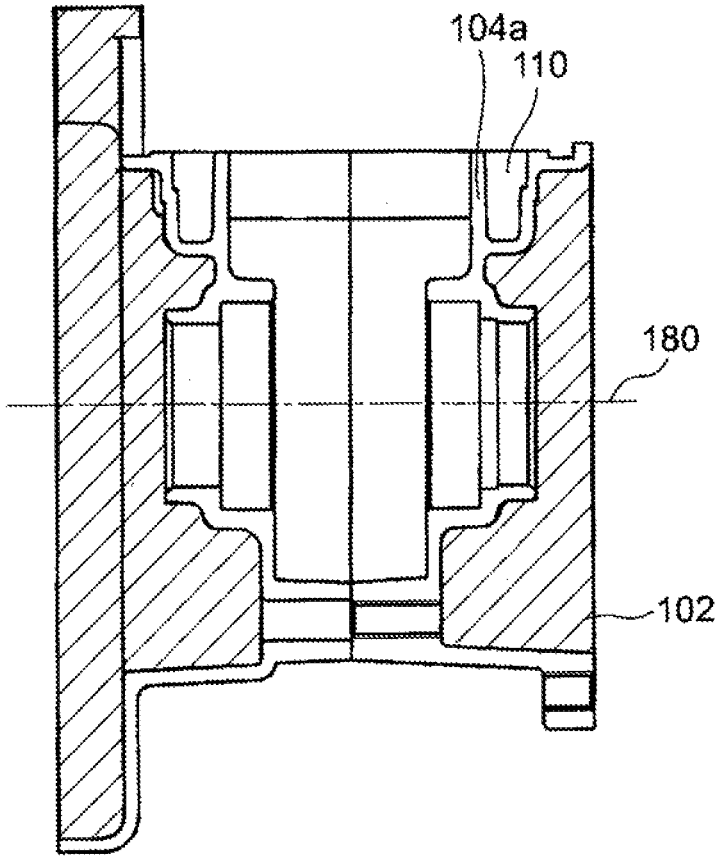
FIG. 11 is a cross section as viewed in the direction of arrows H-H in FIG. 10.

FIG. 7 is a top view of the vicinity of a scavenging passage provided in the crankcase according to Embodiment 3, of the part in Embodiment 3 corresponding to part A shown in FIG. 3 of Embodiment 1, shown to a larger scale. The features other than the structure of the scavenging passage 4*a* in Embodiment 3 are the same as those of Embodiment 1 described using FIG. 1 to FIG. 5.

In Embodiment 3, grooves 21*b* and 21*c* are formed each in the contact surface of the crankcase 2 contacting the cover members 22 and in the contact surfaces of the cover members 22 contacting the inner wall surfaces of the crankcase so as to be recessed in the direction of the crankshaft axis 80. The grooves 21*b* are open in the inner wall surfaces 2*c* of the crankcase 2 contacting the cover members 22. The grooves 21*c* are open in the contact surfaces of the cover members 22 contacting the crankcase 2. The grooves 21*b* and 21*c* are formed in the crankcase 2 and the cover members 22, respectively, so that, when the cover members 22 are attached to the crankcase 2 to be in contact with the inner wall surfaces of the crankcase so that the respective open sides of the grooves 21*b* and grooves 21*c* are faced opposite each other, the grooves 21*b* and 21*c* together form smoothly curved scavenging passages 4*a*.

The cover members 22 are fastened in position, with fastening members such as bolts, to the inner wall surfaces of the crankcase 2.

Thus the grooves 21*b* and 21*c* provided in the crankcase 2 and cover members 22 are faced opposite each other in the direction of the crankshaft axis 80 so that the grooves 21*b* and 21*c* together form passages, these passages being the scavenging passages 4*a*.

As in Embodiment 3 described using FIG. 7, grooves may be provided in both of the crankcase 2 and the cover members 22.

Thereby, the production cost can be reduced as the slide cores are made unnecessary, as with Embodiment 1, and in addition, the cover members 22 can be positioned to the crankcase 2 more easily since the mounting position of the cover members 21*b* to the crankcase 2 is determined by the positions of the grooves 21*b* and 21*c*.

INDUSTRIAL APPLICABILITY

The present invention is applicable as a scavenging passage structure for a two-stroke engine, which allows formation of scavenging passages communicating the scavenging ports in the cylinder with the crank chamber inside the crankcase without using slide cores.

The invention claimed is:

1. A scavenging passage structure for a two-stroke engine, having a scavenging passage communicating a scavenging port provided in a cylinder with a crank chamber formed inside a crankcase, said scavenging passage being formed to extend through respective fastening surfaces of said cylinder and said crankcase, wherein said crankcase comprises a front crankcase portion and a rear crankcase portion divided along a front and back split surface, said front and baqck split surface being orthogonal to a crankshaft axis, the scavenging passage structure further having:

a cover member fastened inside each of said front crankcase portion and said rear crankcase portion with fastening members so as to be in contact with a first inner wall surface of said crankcase as viewed in a direction orthogonal to said crankshaft axis; and a groove recessed into a direction of said crankshaft axis in a contact surface between said first inner wall surface of said crankcase and said cover member, and forming part of said scavenging passage connecting to said crank chamber and to an upper face of said crankcase, wherein said cover member is fitted between two second inner wall surfaces which are opposed to each other at respective ends of said first inner wall surface.

2. The scavenging passage structure for a two-stroke engine according to claim 1, wherein said groove is recessed in said first inner wall surface of said crankcase, said cover member being attached in contact with said first inner wall surface of said crankcase so as to close an open part of said groove.

3. The scavenging passage structure for a two-stroke engine according to claim 1, wherein said groove is recessed in said cover member, said cover member being attached in contact with said first inner wall surface of said crankcase so as to close an open part of said groove.

4. The scavenging passage structure for a two-stroke engine according to claim 1, wherein said groove is recessed both in said first inner wall surface of said crankcase and in said cover member, said cover member being attached in contact with said first inner wall surface of said crankcase so that respective open parts of said groove provided in said first inner wall surface of said crankcase and in said cover member face opposite each other.

5. The scavenging passage structure for a two-stroke engine according to claim 1, wherein said cover member is attached to said first inner wall surface at a mounting position determined by being fitted in between opposite inner wall surfaces of said crankcase.

6. The scavenging passage structure for a two-stroke engine according to claim 2, wherein said cover member is attached to said first inner wall surface at a mounting position determined by being fitted in between opposite inner wall surfaces of said crankcase.

7. The scavenging passage structure for a two-stroke engine according to claim 3, wherein said cover member is attached to said first inner wall surface at a mounting position determined by being fitted in between opposite inner wall surfaces of said crankcase.

8. The scavenging passage structure for a two-stroke engine according to claim 4, wherein said cover member is attached to said first inner wall surface at a mounting position determined by being fitted in between opposite inner wall surfaces of said crankcase.

9. The scavenging passage structure for a two-stroke engine according to claim 1, wherein said cover member comprises a first cover member fastened inside said front crankcase portion so as to be in contact with an inner wall surface of said front crankcase portion as viewed in said direction orthogonal to said crankshaft axis, and a second cover member fastened inside said rear crankcase portion so as to be in contact with an inner wall surface of said rear crankcase portion as viewed in said direction orthogonal to said crankshaft axis, and wherein said groove comprises a first groove recessed into a direction of said crankshaft axis in a contact surface between said inner wall surface of said front crankcase portion and said first cover member, and a second groove recessed into a direction of said crankshaft axis in a contact surface between said inner wall surface of said rear crankcase portion and said second cover member.

* * * * *